United States Patent [19]

Taylor et al.

[11] 4,102,105

[45] Jul. 25, 1978

[54] INTERLOCKED CHANNEL SECTION PANELS AND CONNECTORS THEREFOR

[75] Inventors: Donald M. Taylor, Hamilton; Donald H. Ward, Middletown, both of Ohio

[73] Assignee: Armco Steel Corporation, Middletown, Ohio

[21] Appl. No.: 761,479

[22] Filed: Jan. 24, 1977

Related U.S. Application Data

[63] Continuation-in-part of Ser. No. 581,909, May 29, 1975, abandoned.

[51] Int. Cl.[2] ..... E04D 1/34

[52] U.S. Cl. ..... 52/520; 52/528; 52/544; 52/573; 52/714

[58] Field of Search ..... 24/73 B, 81 B; 403/405; 52/460, 472, 478, 481, 489, 493, 509, 512, 520, 521, 528, 544, 545, 549, 573, 714

[56] References Cited

U.S. PATENT DOCUMENTS

| | | | |
|---|---|---|---|
| 1,882,105 | 10/1932 | Wender | 52/544 |
| 3,020,988 | 2/1962 | Bransford | 52/512 |
| 3,116,776 | 1/1964 | Flora | 151/41.75 |
| 3,323,269 | 6/1967 | Widdowson | 52/483 |
| 3,708,943 | 1/1973 | Thomas | 52/588 |
| 3,998,019 | 12/1976 | Reinwall | 52/478 |

FOREIGN PATENT DOCUMENTS

| | | | |
|---|---|---|---|
| 289,816 | 1/1968 | Australia | 52/545 |
| 275,287 | 5/1965 | Australia | 52/520 |
| 77,985 | 9/1949 | Czechoslovakia | 52/520 |

*Primary Examiner*—Stephen J. Novosad
*Assistant Examiner*—Henry Raduazo
*Attorney, Agent, or Firm*—Melville, Strasser, Foster & Hoffman

[57] ABSTRACT

Interlocked channel section panels having an interlocking joint wherein the male and female members are provided with deformable hook portions. During field assembly the female member overlies the male member with the outer surface of the corresponding upstanding members and upper portions of the male and female members adapted to mate throughout their lengths, and the deformable flange hook portions of the male and female members are capable of being reformed so as to conform intimately to effect continuous, positive interlocking of male and female ribs. A clip connector, including a body portion tightly sandwiched between associated corresponding upstanding members, upper portions and deformable flange hook portions of the sidewalls of the coupled panels, and a foot at the other end of the body portion of the clip connector anchored to a supporting member and fastening the connector along with the coupled panels to the supporting member, is also provided.

26 Claims, 40 Drawing Figures

INTERLOCKED CHANNEL SECTION PANELS AND CONNECTORS THEREFOR

CROSS REFERENCE TO RELATED APPLICATION

This application is a continuation-in-part of application Ser. No. 581,909, filed May 29, 1975, and now abandoned, in the names of Donald M. Taylor and Donald H. Ward and entitled "Interlocked Channel Section Panels and Connector Therefor".

BACKGROUND OF THE INVENTION

1. Field of the Invention

This invention relates to roof and wall structure of a type utilizing a plurality of roofing or wall panels of metal channel section, adjacent margins of which are form-coupled to provide a functionally continuous roof or wall structure which can be made with or without weather sealing and will at the same time shed rain and be free of leaks.

2. Description of the Prior Art

The prior art has long sought an interlocking joint for building and for general purpose panels with rib configuration design to facilitate erection and assembly and final positive interlock as a field operation after assembly. However, the prior art has generally been unsuccessful in such attempts.

More particularly, the prior art of field interlocked panels generally requires the male and female panels to be telescoped together. Exemplary of the prior art is the panel structure disclosed in U.S. Pat. No. 3,312,028, in the name of Patrick L. Schroyer.

SUMMARY OF THE INVENTION

Very briefly considered, the present invention contemplates a building structure which includes a plurality of spaced supporting members, a series of pairs of relatively stiff and rigid interlocked metal panels of channel configuration and self-supporting capacity affixed to and closing the space between the spaced supporting members, and clip connectors of a relatively shorter length than the coupled panels anchoring the coupled panels to the supporting members.

Each of the panels is provided with a central web surface portion and a pair of sidewalls projecting outwardly from opposing edges of the web to form interlocked, inverted channel-shaped ribs along the abutting edges of the panels adapted to form rib joints. Each rib joint has an inverted channel-shaped female member secured along the edge of one panel and a corresponding inverted channel-shaped male member secured along the edge of the adjacent panels. The male and female members have corresponding upstanding members projecting from the abutting edges, corresponding upper portions, and deformable flange hook portions extending downwardly from the upper portions toward but not contacting the web surface of the panels.

The male member is formed such that the included angle between the upper portion and the flange hook portion thereof is within the range of 0° to 90°. The female member is formed such that the included angle between the upper portion and the deformable flange hook portion thereof is within the range of 90° to 150°.

During field assembly, the female member is capable of overlying the male member with the outer surface of the corresponding upstanding members and upper portions of the male and female members adapted to mate throughout their lengths, and the deformable flange hook portions of the male and female members are capable of being reformed so as to conform intimately to effect continuous, positive interlocking of male and female ribs.

A clip connector of relatively shorter length than the coupled panels is provided anchoring the coupled sidewalls and the panels provided therewith to the supporting members. The clip connector includes a body portion tightly sandwiched between associated corresponding upstanding members, upper portions and flange hook portions of the sidewalls of the coupled panels, and a foot at the other end of the body portion of the clip connector anchored to a supporting member and fastening the connector along with the coupled panels to the supporting member. The foot of the clip connector is provided with an elongated slot and a washer member which guarantees centering during installation and provides for movement of the roofing system with respect to the plurality of spaced supporting members or purlins during thermal movement of the panels.

In a preferred embodiment, the included angle between the upper portion and the flange hook portion of the male member is about 90° and the included angle between the upper portion and the flange hook portion of the female member is about 90°. In a further preferred embodiment the included angle between the upper portion and the flange hook portion of the male member may be within the range of 0° to 90° and the included angle between the upper portion and the flange hook portion of the female member is about 90°. In still a further embodiment, the included angle between the upper portion and the flange hook portion of the male member is about 90° and the included angle between the upper portion and the flange hook portion of the female member is within the range of 90° to 150°.

In a preferred embodiment the female member may include an outer most bend retention hook extending from the deformable flange hook portion of the female member. The outermost bend retention hook is preformed such that the included angle between the deformable flange hook portion and the outermost bend retention hook of the female member is about 90°.

DESCRIPTION OF THE PREFERRED EMBODIMENTS

Figure 1:
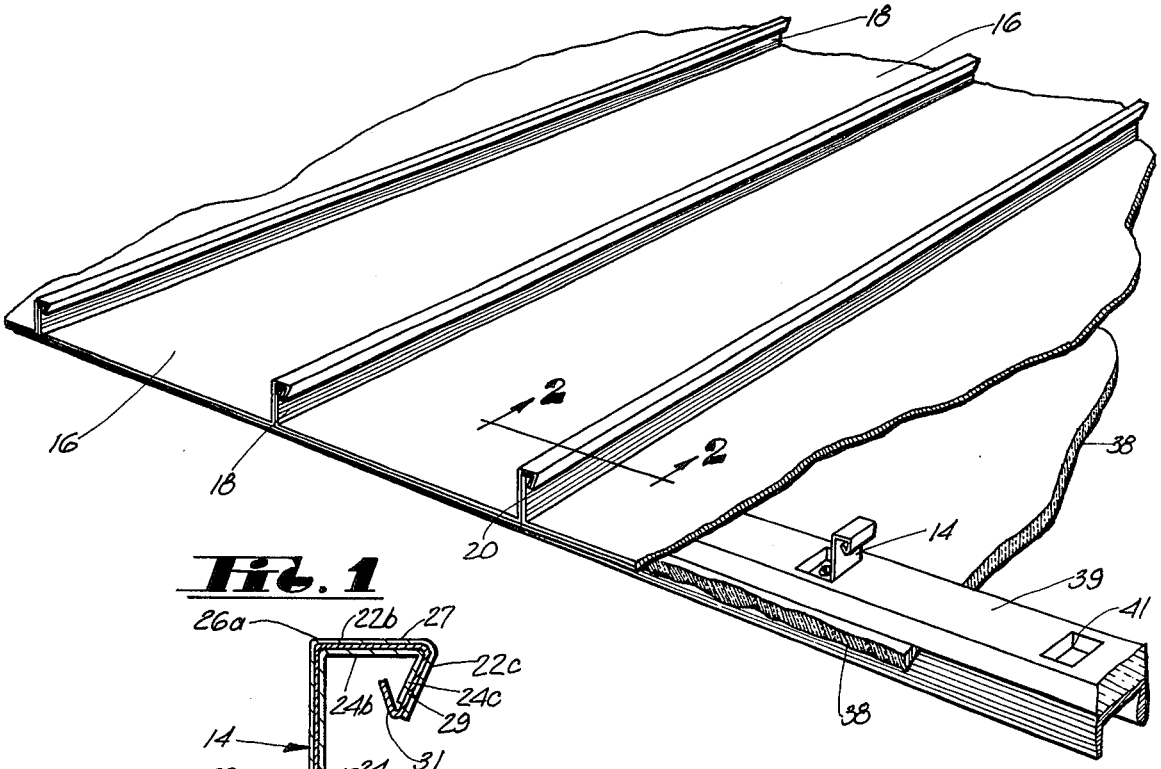
FIG. 1 is a perspective view of an exemplary roof structure showing pairs of interlocked panels of the present invention with clip connectors anchoring them to a supporting member.
Figure 2:
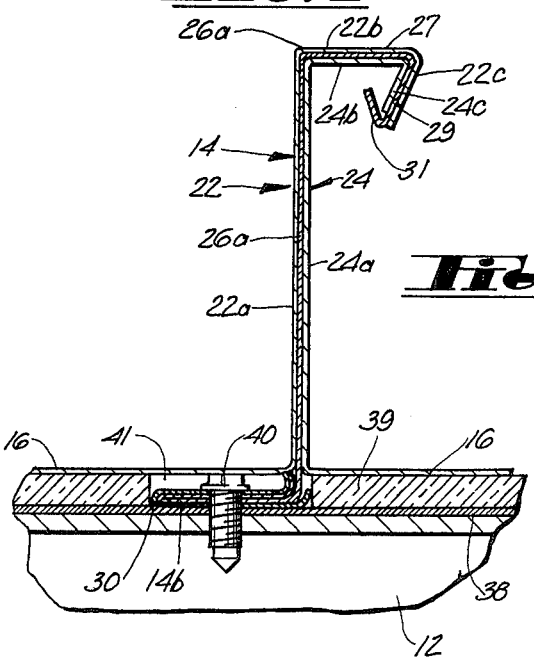
FIG. 2 is a cross sectional view taken on the line 2—2 of FIG. 1 showing the rib joint of the present invention, including the clip connector.

Referring now to the drawings, and in particular to FIG. 1, it will be seen that a typical building structure incorporating the present invention may include a series of pairs of relatively stiff and rigid interlocked metal panels 10 of channel configuration and self-supporting capacity affixed to and closing the space between spaced supporting members, such as, for example, the purlin 12, and clip connectors 14, which are of a relatively shorter length than the coupled panels 10 and anchor the coupled panels 10 to the purlin 12.

Each of the panels is provided with a central web surface 16 and a pair of sidewalls 18 projecting outwardly from opposing edges of the web 16 to form inverted channel-shaped ribs along the abutting edges of the panels 10 adapted to form rib joints 20. Each rib joint 20 has an inverted channel shaped female member 22 secured along the edge of one panel 10 and a corresponding inverted channel-shaped male member 24 secured along the edge of the adjacent panel 10. The male and female members 24 and 22, respectively, have corresponding upstanding members *24a* and *22a* projecting from the abutting edges, corresponding upper portions *24b* and *22b*, and deformable flange hook portions *24c* and *22c* extending downwardly from the upper portions *24b* and *22b*, respectively, toward but not contacting the web surface 16 of the panels 10.

In practice it is sometimes common to refer to the upstanding member *24a*, *22a* the upper portion *24b*, *22b*, and the deformable flange hook portion *24c*, *22c*, of each male and female member 24 and 22, a rib, a rib flange, and a rib hook or rib lip, respectively. However, for purposes of this description, each male and female member 24 and 22 is defined as an inverted channel shaped rib, the inverted channel shaped ribs interlocking to form a rib joint 20. Each male and female inverted channel shaped rib 24 and 22, respectively, includes an upstanding member *24a*, *22a*, and upper portion *24b*, *22b*, and a deformable flange hook portion *24c*, *22c*.

Figure 14:
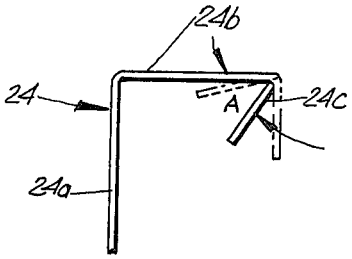
FIG. 14 is an end view of an outwardly projecting male member showing the range of the included angle between the upper portion and the flange hook portion thereof.
Figure 15:
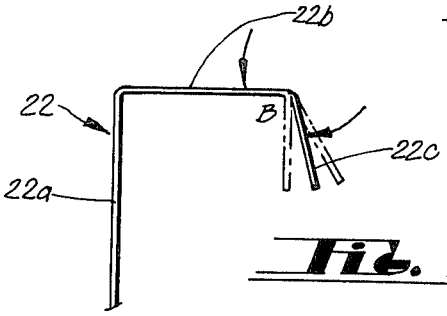
FIG. 15 is an end view of an outwardly projecting female member showing the range of the included angle between the upper portion and the deformable flange hook portion thereof.
Figure 10:
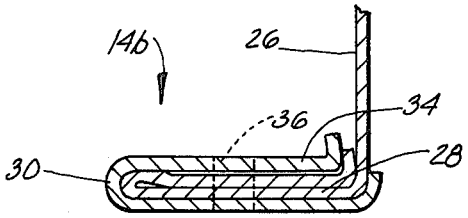
FIG. 10 is an enlarged cross sectional view taken on the line 10—10 of FIG. 8.
Figure 12A:
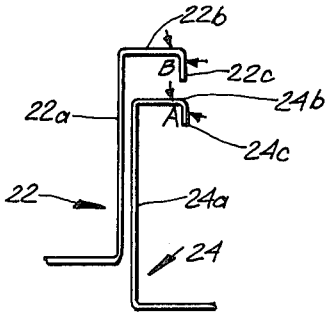
FIG. 12A through 12D are end views of the female member overlying an associated male member showing the preferred embodiments of the panels of the present invention.
Figure 12B:
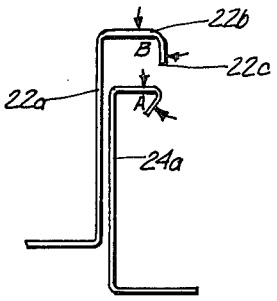
Figure 12C:
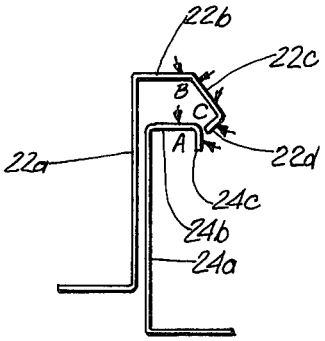
Figure 12D:
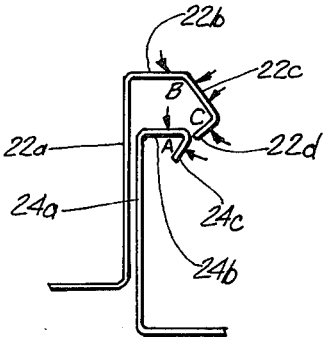

The male member 24 is formed such that the included angle A (as best seen in FIGS. 12D and 14) between the upper portion *24b* and the deformable flange hook portion *24c* is within the range of 0° to 90°. The female member 22 is formed such that the included angle B (as best seen in FIGS. 12D and 15) between the upper portion *22b* and the deformable flange hook portion *22c* is within the range of 90° to 150°.

In a preferred embodiment, as best seen in FIG. 12A, the included angle A between the upper portion *24b* and the flange hook portion *24c* of the male member 24 is about 90° and the included angle B between the upper portion *22b* and the flange hook portion *22c* of the female member 22 is about 90°. In a further preferred embodiment, as best seen in FIG. 12B, the included angle A between the upper portion *24b* and the flange hook portion *24c* of the male member 24 is within the range of 0° to 90° and the included angle B between the upper portion *22b* and the flange hook portion *22c* of the female member 22 is approximately 90°. In still a further preferred embodiment, as best seen in FIG. 12c, the included angle A between the upper portion 24b and the flange hook portion 24c of the male member 24 is approximately 90° and the included angle B between the upper portion 22b and the flange hook portion 22c of the female member is within the range of 90° to 150°.

Figure 7:
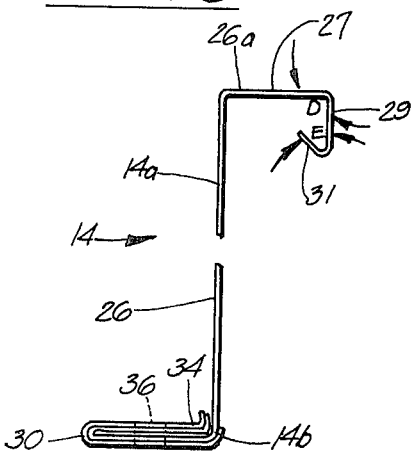
FIG. 7 is an end view of a clip connector according to the present invention.
Figure 9:
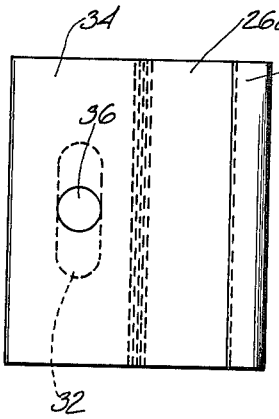
FIG. 9 is a bottom view of the clip connector of FIG. 7.
Figure 13A:
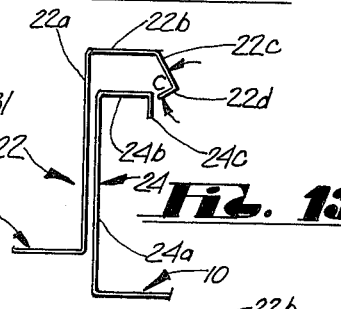
FIG. 13A is an end view of an outwardly projecting female member of a panel showing a retention hook.
Figure 13B:
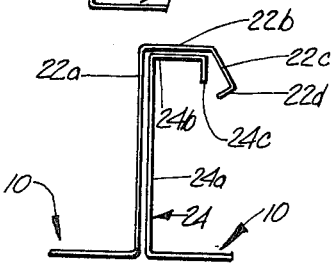
FIG. 13B is an end view of the female member of FIG. 13A overlying an associated male member.
Figure 8:
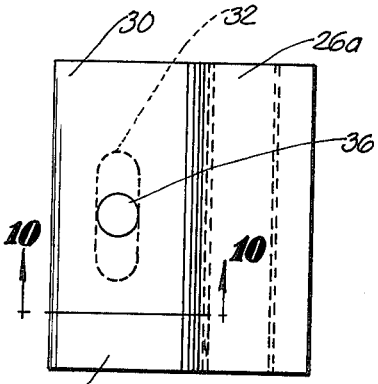
FIG. 8 is a top view of the clip connector of FIG. 7.
Figure 11:
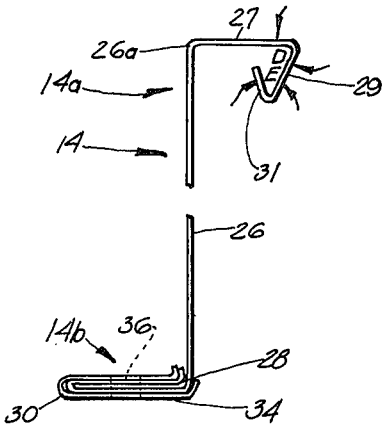
FIG. 11 is an end view of a second embodiment of the clip connector according to the present invention.

The clip connectors 14 are best seen in FIGS. 7 through 11 and 16 through 35. As can be seen, the clip connector 14 comprises a body portion 14a and a foot 14b. The body portion 14a comprises an upstanding planar element 26 the upper portion 26a thereof which is hook shaped and comprises an upper portion 27, a deformable flange hook portion 29 extending downwardly from the upper portion 27, and, if desired, an outermost bend retention hook 31 extending from the deformable flange hook portion of the clip connector 14. The body portion 14a of the clip connector 14 is configured such that it conforms to the outside surface of the upstanding member 24a, upper portion 24b and hook flange portion 24c of the male member 24. In this regard, and as best seen in FIG. 11, the clip connector 14 is formed such that the included angle D between the upper portion 27 and the deformable flange hook portion 29 thereof is within the range of 15° to 90°, and the included angle E between the deformable flange hook portion 29 and the outermost bend retention hook 31, when utilized, is within the range of 25° to 90°. However, in a further preferred embodiment, as best seen in FIGS. 7 through 9, the clip connector 14 is formed such that the included angle D between the upper portion 27 and the deformable flange hook portion 29 thereof is about 90° and the included angle E between the deformable flange hook portion 29 and the outermost bend retention hook 31 is within the range of 25° to 90°.

The foot 14b of the clip connector 14 is formed from the bottom of the planar element 26 and, in the embodiment of FIGS. 7 through 11, comprises a return bent flange 28 having an elongated slot 32 formed therein extending longitudinally thereof. A washer member 30 is located on the return bent flange 28 and preferrably comprises a U-shaped member which is snugly received on the return bent portion 28. An aperture 36 is provided through the legs 34 of the U-shaped member 30 in alignment with the elongated slot 32.

Figure 16:
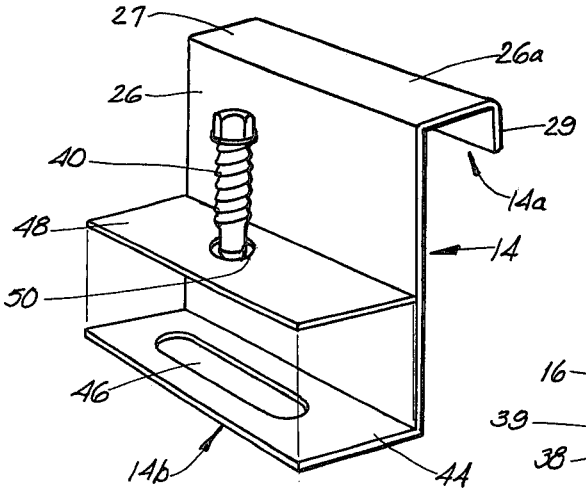
FIG. 16 is an exploded perspective view of a further embodiment of a clip connector according to the present invention.
Figure 17:
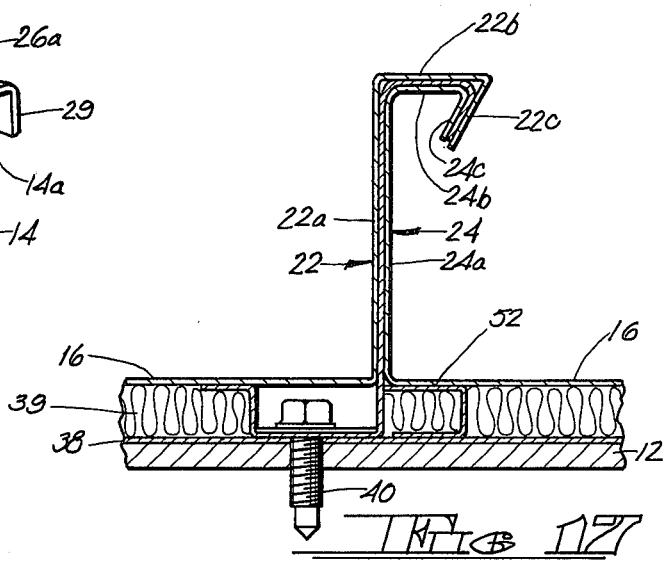
FIG. 17 is a cross sectional view similar to FIG. 2 showing the rib joint of the present invention and yet another embodiment of a clip connector according to the present invention.
Figure 18:
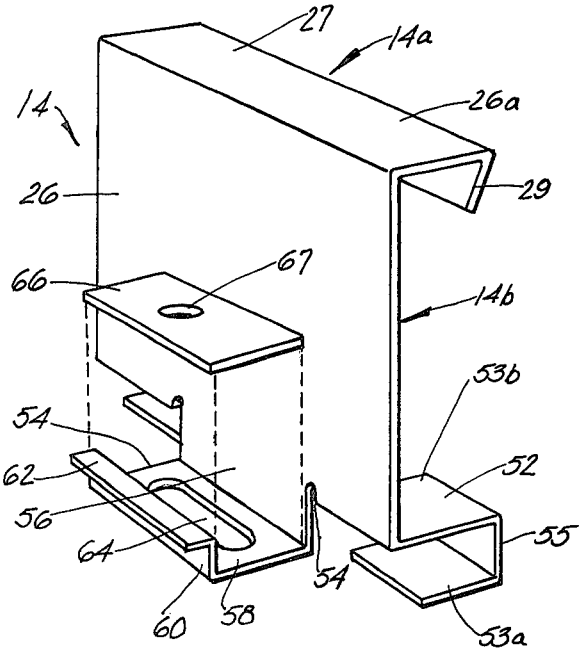
FIG. 18 is an exploded perspective view of the clip connector of FIG. 17.
Figure 19:
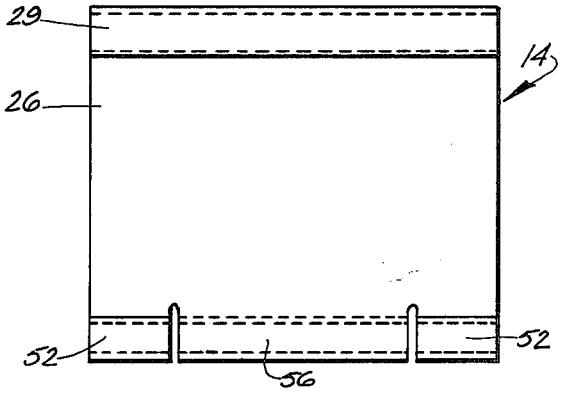
FIG. 19 is a front elevational view of the clip connector of FIG. 17.
Figure 20:
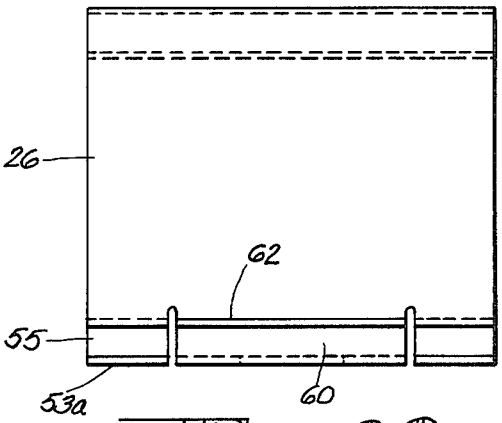
FIG. 20 is a rear elevational view of the clip connector of FIG. 17.
Figure 22:
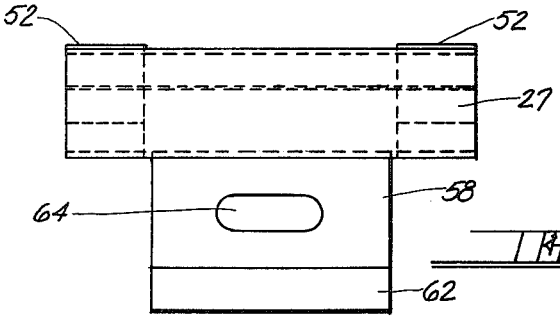
FIG. 22 is a top plan view of the clip connector of FIG. 17.
Figure 21:
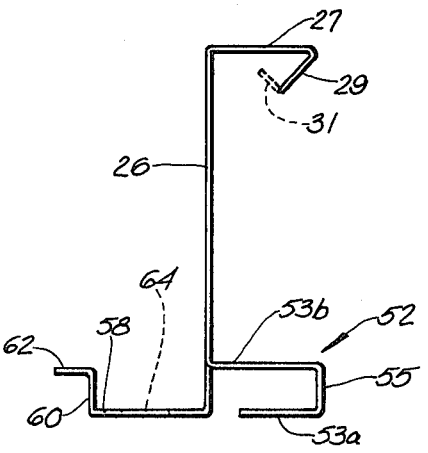
FIG. 21 is an end view of the clip connector of FIG. 17.
Figure 23:
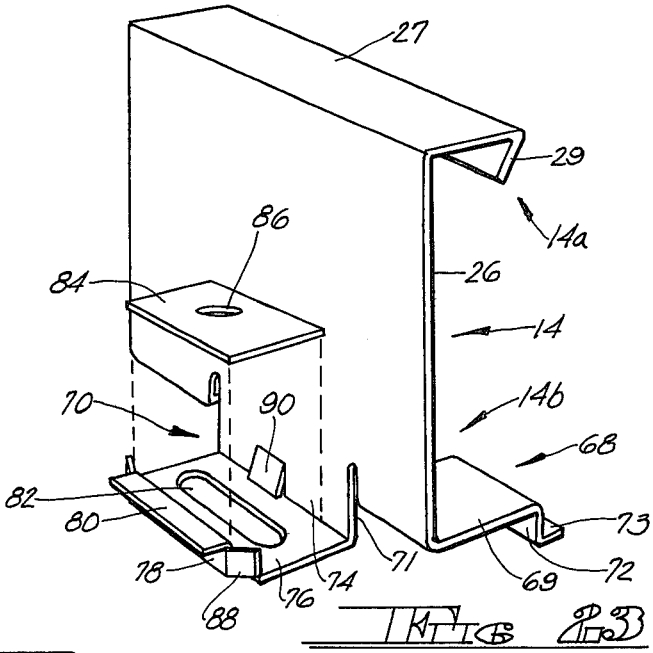
FIG. 23 is an exploded perspective view of yet another embodiment of a clip connector according to the present invention.
Figure 24:
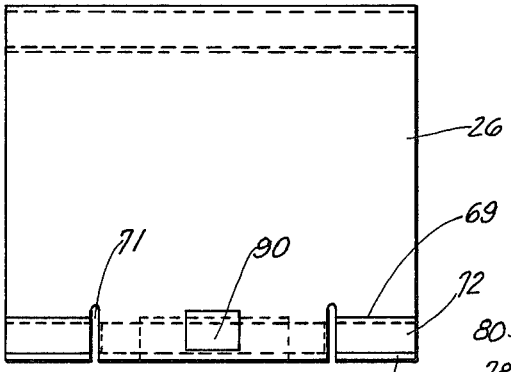
FIG. 24 is a front elevational view of the clip connector of FIG. 23.
Figure 26:
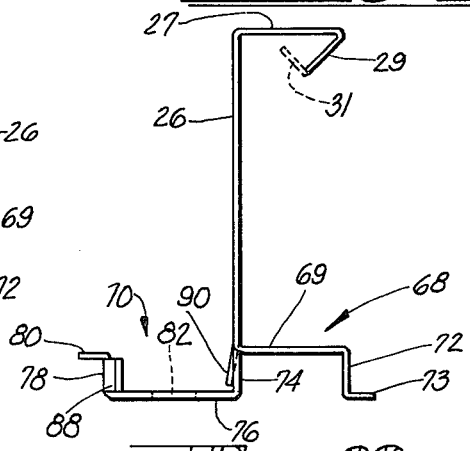
FIG. 26 is an end view of the clip connector of FIG. 23.
Figure 25:
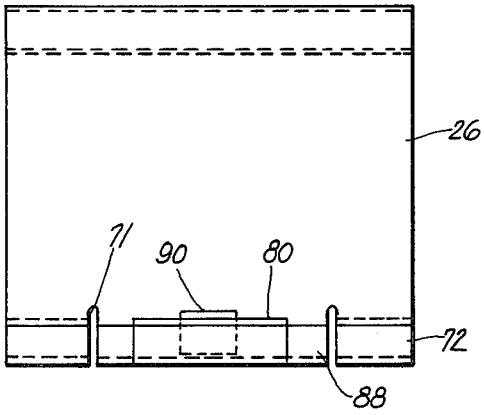
FIG. 25 is a rear elevational view of the clip connector of FIG. 23.
Figure 27:
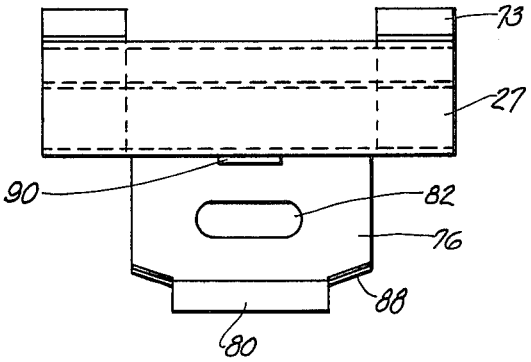
FIG. 27 is a top plan view of the clip connector of FIG. 23.
Figure 28:
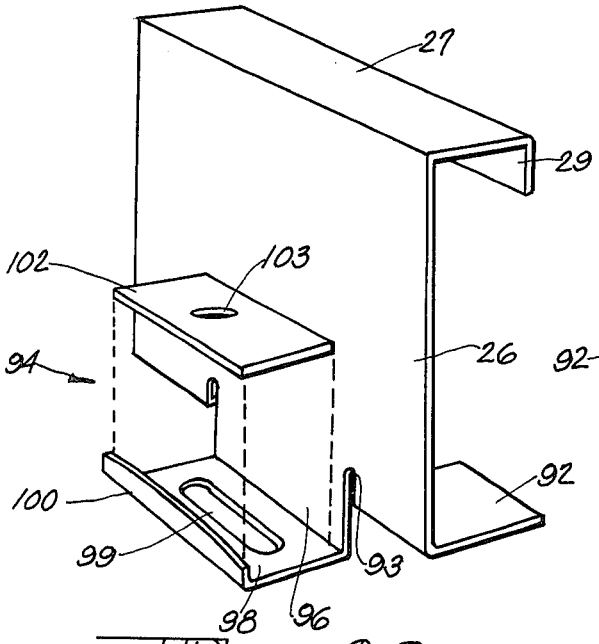
FIG. 28 is an exploded perspective view of yet another embodiment of a clip connector according to the present invention.
Figure 29:
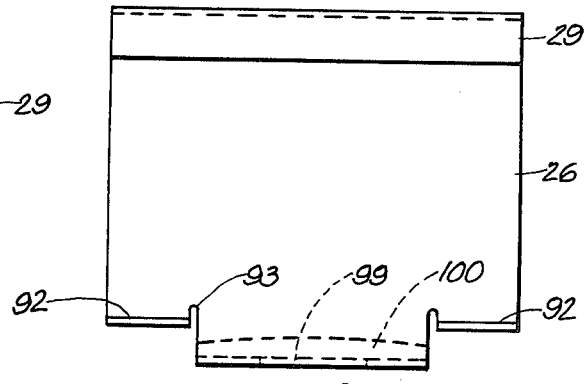
FIG. 29 is a front elevational view of the clip connector of FIG. 28.
Figure 30:
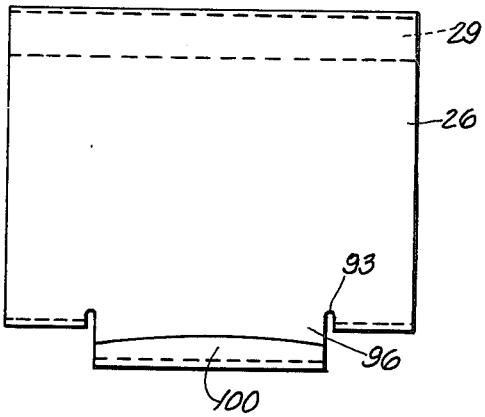
FIG. 30 is a rear elevational view of the clip connector of FIG. 28.
Figure 31:
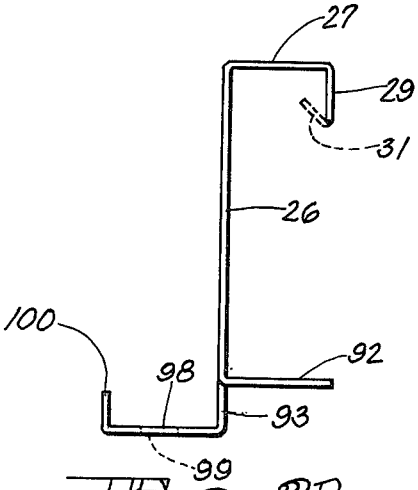
FIG. 31 is an end view of the clip connector of FIG. 28.
Figure 32:
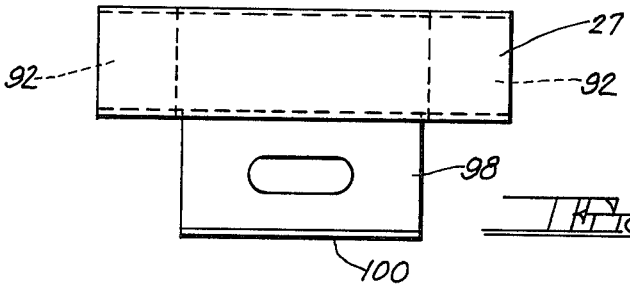
FIG. 32 is a top plan view of the clip connector of FIG. 28.

Further embodiments of the foot 14b of the clip connector 14 are shown in FIGS. 16 through 35. Turning first to FIG. 16, it will be seen that the foot 14b is formed from the bottom of the planar element 26 and comprises a flange 44 of single thickness substantially normal to the element 26. The flange 44 is provided with an elongated slot 46 extending longitudinally thereof substantially parallel to the element 26. A washer member 48 of one thickness and substantially the same length and width as the flange 44 may be positioned on the flange 44 with an aperture 50 therethrough centrally aligned with the slot 46 when the edges of the washed member 48 are substantially aligned with the edges of the flange 44.

The foot 14b of the embodiment of FIGS. 17 through 22, comprises a pair of U-shaped members 52 extending outwardly from edge portions of the bottom of the planar element 26 and a back clip 54 formed from the remaining intermediate portion of the planar element 26 extending outwardly in the opposite direction from the U-shaped members 52. The U-shaped members 52 are formed from cuts 54 parallel to the edges of the planar element 26 and are configured into U-shaped elements with one leg 53 thereof having a free end such that when the clip connector 14 is sandwiched between associated interlocked metal panels 10, the legs of each of the U-shaped members 52 are substantially perpendicular to the planar element 26 and the base 55 of each U-shaped member 52 is substantially parallel to the planar element 26.

The back clip 54 comprises a first portion 56 coplanar with the planar element 26, a second portion 58 substantially perpendicular to the first portion 56 and substantially coplanar with those legs 53 of the U-shaped members 52 which have free ends, and a third portion 60 substantially perpendicular to the second portion 58 and substantially parallel to the first portion 56. An elongated slot 64 is formed in the second portion 58 and a washer member 66 is configured to overlie the second portion 58 of the backup clip 54 between the first and third portions 56 and 60, respectively, thereof. The back clip 54 may also be provided with a fourth portion 62 substantially parallel to the second portion 58, perpendicular to the third portion 60 and extending from a third portion 60 in a direction opposite to the second portion 58, the clip connector 14 being configured such that when it is sandwiched between associated interlocked metal panels 10, the fourth portion 62 is substantially coplanar with the integral legs 53b of the U-shaped members 52.

The foot 14b of the embodiment of FIGS. 23 through 27 comprises a pair of first members 68 each having first portions 69 extending outwardly from the edge portions of the bottom of the planar element 26 and a back clip 70 formed from the remaining intermediate portion of the planar element 26 extending outwardly in the opposite direction from the first members 69. The first members 69 are formed from cuts 71 parallel to the edges of the planar element 26, the first portions 69 of the first members 68 being substantially normal to the planar element 26 and substantially parallel to the upper portion 27 of the clip 14 and to the back clip 70. Each of the first members 68 also includes a second portion 72 substantially perpendicular to the first portion 69 thereof and extending downwardly therefrom in a plane substantially parallel to the planar element 26, and a third portion 73 substantially parallel to the first portion 69 thereof, perpendicular to the second portion 72 thereof, and extending from the second portion 72 thereof in a direction opposite to the first portion 69 thereof.

The back clip 70 comprises a first portion 74 coplanar with the planar element 26, a second portion 76 substantially perpendicular to the first portion 74 and substantially coplanar with the first portions 69 of the first members 68, a third portion 78 substantially perpendicular to the second portion 76 and substantially parallel to the first portion 74, and a fourth portion substantially parallel to the second portion 76 thereof, perpendicular to the third portion 78 thereof, and extending from the third portion 78 thereof in a direction opposite to the second portion 76 thereof. An elongated slot 82 is provided in the second portion 76 of the back clip 70 and a washer member 84 having a central aperture 86 is configured to overlie the second portion 76 between the first and third portions 74 and 78, respectively, thereof, with the aperture 86 being centrally aligned with respect to the slot 82.

As can be seen, the third portion 78 of the back clip 70 has the ends 88 thereof bent at a slight angle toward the first portion 74 thereof to form a first retainer, whereby the washer member 84 is permanently centered with respect to the back clip 70, thus maintaining the aperture 86 centrally aligned with respect to the slot 82. A second retainer 90 may be provided extending from the surface of the first portion 74 over the washer member 84.

The foot **14*b* of the embodiment of FIGS. 28 through 32 comprises a pair of first members 92 each having first portions extending outwardly from the edge portions of the bottom of the planar element 26 and a back clip 94 formed from the remaining intermediate portion of the planar element 26 extending outwardly in the opposite direction from the members 92. The first members 92 are formed from cuts 93 parallel to the edges of the planar element 92 and are formed such that they are substantially normal to the planar element 26 and substantially parallel to the upper portion 27 and to the back clip 94**.

The back clip 94 comprises a first portion 96 coplanar with the planar element 26, a second portion 98 substantially perpendicular to and coplanar with the first portion 96 and substantially coplanar with the first portions 92 of the first members, and a third portion 100 substantially perpendicular to the second portion 98 and substantially parallel to the first portion 96. An elongated slot 99 is formed in the second portion 98 of the back clip 94 and a washer 102 having a central aperature 103 is configured to overlie the second portion 98 of the back clip 94. In practice the washer 102 overlies the second portion 98 of the back clip 94 between the first and third portions 96 and 100, respectively, thereof, with the aperature 103 centrally aligned with respect to the slot 99.

Figure 33:
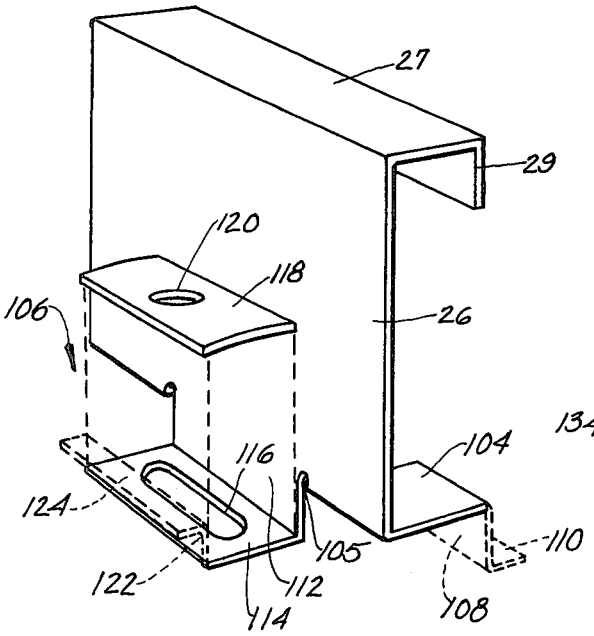
FIG. 33 is an exploded perspective view of yet another embodiment of the clip connector of the present invention.

The foot **14*b* of the embodiment of FIG. 33 comprises a pair of first members 104 each having first portions extending outwardly from the edge portions of the bottom of the planar element 26 and a back clip 106 formed from the remaining intermediate portion of the planar element 26 extending outwardly in the opposite direction from the first members 104. The first members are formed from cuts 105 parallel to the edges of the planar element 26. The first portions 104 of the first members are substantially normal to the planar element 26 and substantially parallel to the upper portion 27 and to the back clip 106**.

Each of the first portions 104 of the first members includes a second portion 108 substantially perpendicular to the first portion 104 thereof and extending downwardly therefrom in a plane substantially parallel to the planar element 26, and a third portion 110 substantially parallel to the first portion 104, perpendicular to the second portion 108, and extending from the second portion 108 thereof in a direction opposite to the first portion 104 thereof.

The back clip 106 includes a first portion 112 coplanar with the planar element 26 and a second portion 114 substantially perpendicular to the first portion 112 of the back clip 106 and substantially coplanar with the first portion 104 of the first members. As elongated slot 116 is formed in the second portion 112 and a washer 118 having a central aperture 120 is configured to overlie the second portion 114 of the back clip with the aperture in alignment with the slot 116. If desired, the back clip 106 may also include a third portion 122 substantially perpendicular to the second portion 114 and substantially parallel to the first portion 112, as well as a fourth portion 124 substantially parallel to the second portion 114 thereof, perpendicular to the third portion 122 thereof, and extending from the third portion 122 thereof in a direction opposite to the second portion 114 thereof.

It will, of course, be understood that the foot portions **14*b* as shown in the various embodiments may or may not include first members, such as the members 104 in FIG. 33, having second and third portions 108 and 110, respectively, thereof, and that the use of such portions is a matter of choice. Additionally, it will, of course, be understood that the back clip, such as the back clip 106 may or may not include the third and fourth portions 122 and 124, respectively, as desired. Finally, it will be understood that the clips of the various embodiments may or may not include an outermost bend retention hook, such as the hook 31, extending from the deformable flange hook portion 29** of the body portion.

Figure 34:
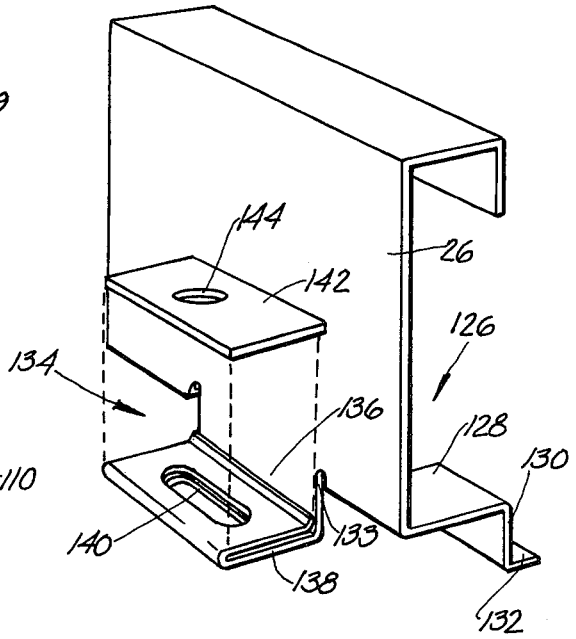
FIG. 34 is an exploded perspective view of yet another embodiment of the clip connector of the present invention wherein the foot thereof comprises a return bent flange.

The foot **14*b* of the embodiment of FIG. 34 comprises a pair of first members 126 each having first portions 128 extending outwardly from the edge portions of the bottom of the planar element 26, a second portion 130 substantially perpendicular to the first portion 128 thereof and extending downwardly therefrom in a plane substantially parallel to the planar element 26, and a third portion 132 substantially parallel to the first portion 128 thereof, perpendicular to the second portion 130 thereof, and extending from the second portion 130 thereof in a direction opposite to the first portion 128 thereof. The first members 126 are formed from cuts 133 parallel to the edges of the planar element 26**.

The foot **14*b* of the embodiment of FIG. 34 also includes a back clip 134 formed from the remaining intermediate portion of the planar element 26 extending outwardly in the opposite direction from the first members 126. The back clip 134 comprises a first portion 136 coplanar with the planar element 26 and a second portion 138 substantially perpendicular to the first portion 136 thereof and substantially coplanar with the first portions 128 of the first members 126. As can be seen, the second portion 138 of the back clip 134 is bent over upon itself to form a return bent flange. An elongated slot 140 is formed in the second portion 138 of the back clip 134 and extends longitudinally thereof substantially parallel to the body portion of the clip. A washer member 142 having a central aperture 144 in alignment with the elongated slot 140 overlies the second portion 138**.

Figure 35:
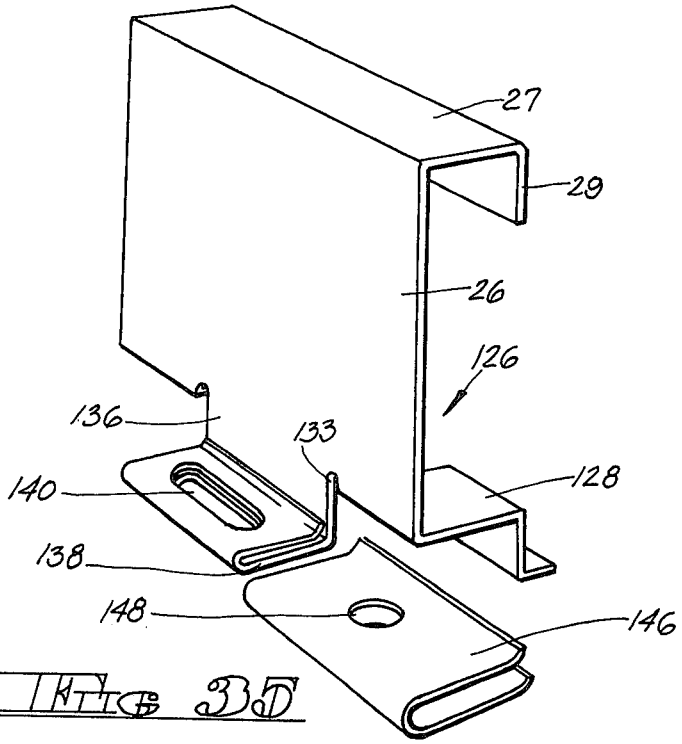
FIG. 35 is an exploded perspective view of yet another embodiment of the clip connector of the present invention wherein the foot thereof comprises a return bent flange and the washer member is a U-shaped member.

The foot **14*b* of the embodiment of FIG. 35 is identical with the foot 14*b* of the embodiment of FIG. 34, with the sole exception that the washer member 146 comprises a U-shaped member which is snuggly and slidably received on the return bent flange of the second portion 138 of the back clip 134. As can be seen an aperture 148 extends through the legs of the U-shaped member 146 so that when it is snuggly and slidably received on the second portion 138, the aperture 148 is in alignment with the elongated slot 140**.

It will, of course, be noted that in all of the clip embodiments of the present invention, the aperture in the washer member is centrally aligned with respect to the elongated slot in the back clip of the foot portion when the washer member is properly positioned with respect to the back clip. Such positioning is generally the result of properly aligning the edges of the washer member with the edges of the back clip.

The clip connectors 14 of the present invention guarantee centering during installation and provide for movement of the roofing system with respect to the plurality of spaced supporting members or purlins 12 during thermal movement of the panels 10. It will, of course, be understood that during thermal expansion of the panels 10, the roofing system should move with respect to the purlins 12 rather than the panels 10 moving with respect to the clip connectors 14. For example, if the panels 10 move while the clip connectors 14 are stationary, the clip connectors 14 can break the seal 42 on the underside of the female member 22. After a period of time, the roofing system may no longer be water tight.

It should, perhaps, be noted that with the concern regarding energy conservation, roll insulation 38 is regularly applied to the underside of roofing panels. This results in even greater temperature change and greater movement of the panels 10, further emphasizing the importance for permitting lateral movement.

FIGS. 3 through 6 generally show the field assembly of a building structure incorporating therein the panels 10 and the clip connectors 14 of the present invention. More particularly, the first step of erection includes the placement of a small bead of sealant 42 on the upper portion **24*b* of the male member 24. It should be noted that the suitable sealant 42 may alternately be factory applied sealant inside the clip connector 14, in lieu of tape or cartridge grade sealants which are applied by the workman before the clip connector 14 is engaged with the male member 24**.

At this point it should also be noted that it has been found that the sealant may be applied to the rib 20 during the manufacture of the panel 10, and that this is generally accomplished by placing sealant on the underside of the upper portion **22*b* of the female member 22**.

Figure 4:
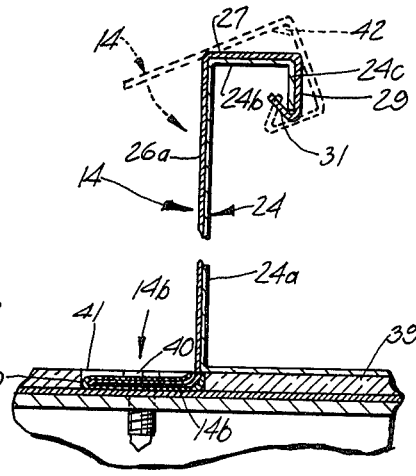
FIG. 4 is a view similar to FIG. 3 showing the clip connector in place.

Suitable insulation 38, such as blanket or roll insulation, is then installed in the normal fashion over the supporting members or purlins 12. Rectangular insulation strips 39, preferably of dense non-metallic substance such as, for example, urethane, having apertures or slots 41 therein for receiving the clip connectors 14, are than laid on the spaced members or purlins 12. The web surfaces 16 of a run of panels 10 are then placed against the insulation 38 and 39. Thereafter, as shown in FIG. 4, clip connectors 14 are rotatably and shiftably positioned over the male member 24, of each panel 10, with the body portion **14*a* of the clip connector 14, including the upstanding member 26, the upper portion 27, and the flange hook portion 29 in engagement with the upstanding members 24*a*, the upper portions 24*b* and the flange hook portions 24*c* of the male members 24 of the panels 10, and the foot 14*b* of each clip connector 14, with the washer member 30, fitting into the slot 41 in the rectangular insulation strip 39. It will, of course be noted that the retention hook 31 of the clip connectors 14 preclude the male members 24 from "rotating out" when uplift is applied to the panels 10**.

A self drilling screw 40 is then directed through each of the apertures 36 in the washer members 30 and the elongated slots 32 in the foot **14*b* of the clip connectors 14 into the supporting member or purlin 12 to secure the foot 14*b* of each clip connector 14** thereto.

At this point it should be noted that the "over hooking" clip connector 14 does not permit adequate movement between the clip connector 14 and the panel rib 20, which, as previously explained, is of importance in order to allow for thermal movement of the panels 10, and that provision for such movement has been made at the point of fastening the series of panels 10 to the supporting members or purlins 12. This has been accomplished by providing an elongated slot 32 in the foot portion **14*b* of the clip connectors 14 of such size as to accommodate the required movement. However, it must be emphasized that this approach will only be effective if the screw 40 is installed in the center of the slot 32, 46, 64, 82, 99, 116, 140 so as to provide forward and reverse movement as required. Such installation is assured according to the present invention because of the washer member 30, 48, 66, 84, 102, 118, 142, 146 secured to the foot 14*b* of the clip connector 14, which provides for the centering of the aperture 36, 50, 67, 86, 103, 120, 144, 148 with respect to the slot 32, 46, 64, 82, 99, 116 & 140**.

Figure 6:
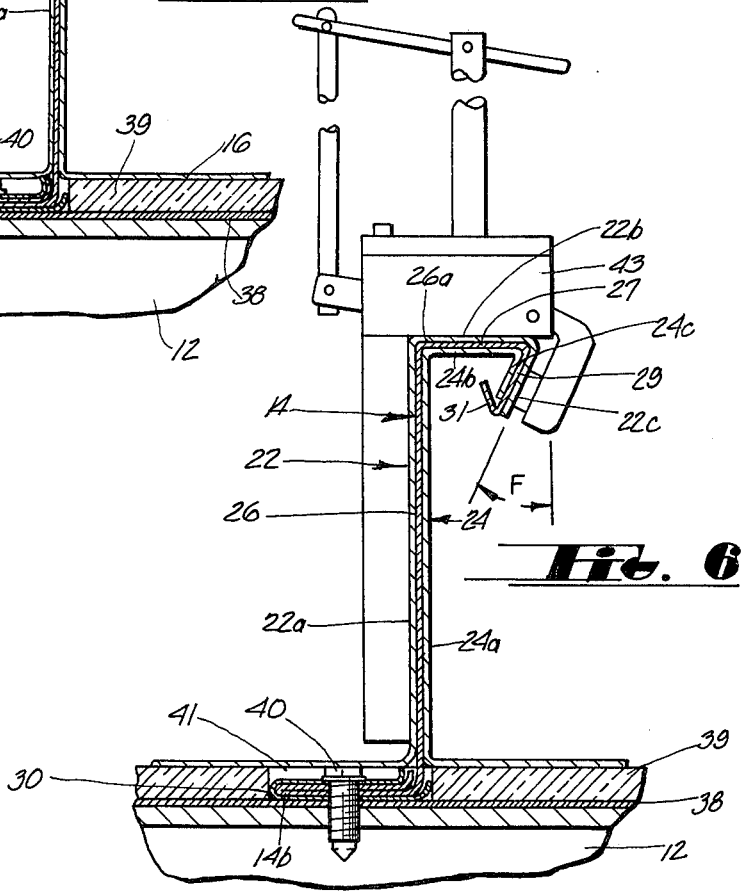
FIG. 6 is an end view of the abutting panel of FIG. 5 showing use of a hand crimper at the location of the clip connector.
Figure 3:
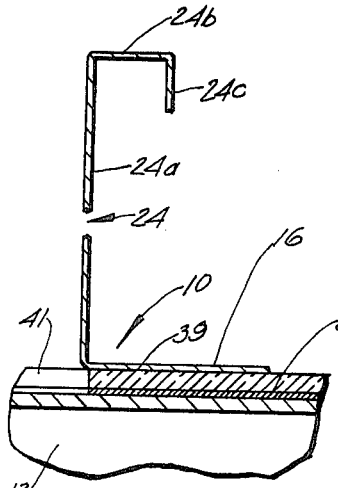
FIG. 3 is a cross sectional view showing a purlin member with an associated panel having an outwardly projecting male member.
Figure 5:
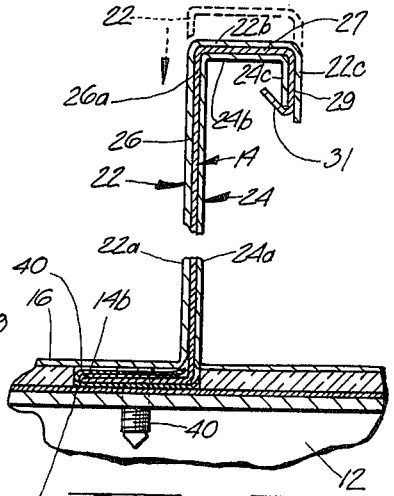
FIG. 5 is an end view similar to FIG. 4, showing an abutting panel with an outwardly projecing female member.

Following the setting of the screws 40, the female member 22 of a panel 10 is overlaid upon the male member 24, with the planar element 26 and the hook portion **26*a*, including the upper portion 27, and the flange hook portion 29, of the clip connector 14 sandwiched between the upstanding members 22*a* and 24*a* and the upper portions 22*b* and 24*b* of the female and male members 22 and 24, respectively, as shown in FIG. 5. The deformable flange hook portions 24*c* and 22*c* of the male and female members 24 and 22, respectively, may then initially be reformed using a hand crimper 43, as indicated in FIG. 6. The initial crimp is completed at the location of the clip connectors 14, with the hand crimper 43 being adjusted such that the panels 10 will not separate. It has been found that the angle F of the crimp is generally about 45°. An electric power crimping device follows and completes the crimping operation along the entire length of the rib 20, thus forming the deformable flange hook portions 24*c* and 22*c* of the male and female members 24 and 22, respectively, to conform initimately to effect continuous, positive interlocking of male and female members 24 and 22 to form the rib 20**.

Figure 13C:
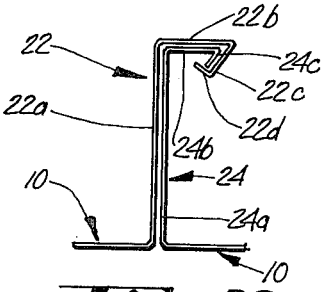
FIG. 13C is an end view showing the rib joint of FIG. 13B after field assembly.

As shown in FIGS. 12C, 12D and 13A through 13C, an outermost bend retention hook 22D may be provided extending from the deformable flange hook portion **22*c* of the female member 22. The outermost bend retention hook 22*d* is performed such that the included angle C between the deformable flange hook portion 22*c* and the outermost bend retention hook 22*d* of the female member 22 is about 90°. Accordingly, when the deformable flange hook portions 24*c* and 22*c* of the male and female members 24 and 22, respectively, are formed in intimate contact, as shown in FIG. 13C, positive engagement and interlocking with the corresponding preformed flange hook portion 24*c* of the male member 24 is assured throughout the entire length of the rib 20**.

The interlocked channel section panel and clip connector of the present invention provide an interlocking joint for building and for general purpose panels with rib configuration design which facilitates erection and assembly and assures final positive interlock as a field operation after assembly. This requires the bending of the deformable hook portions of the male and female members to the final desired configuration. It should be emphasized that the construction of the present invention eliminates the engagement of completely preformed panels by telescoping one rib configuration into the other, which is entirely impractical for long panels and within the limit of production metal forming equally impractical for short panels, since panel length has no effect on assemblying panels in accordance with the teachings of the present invention. Additionally, the present invention provides a roofing system which, during thermal movement of the panels, will move with respect to the purlins rather than the panels moving with respect to the clip connectors.

It will be apparent to the skilled worker in the art that numerous modifications can be made in this invention without departing from its scope and spirit. Accordingly, no limitations are intended except in so far as specifically set forth in the claims which follow.

We claim:

1. A clip connector for anchoring pairs of rigid interlocked metal panels of channel configuration to spaced supporting members comprising a body portion having an upstanding planar element, an upper horizontal planar portion, a deformable flange hook portion comprising a planar element depending downwardly from said upper portion and deformable towards said upstanding planar element at the line of juncture between said deformable flange hook portion and said upper horizontal planar portion, an outermost bend retention hook extending from the free end of said deformable flange hook portion of said body portion, said retention hook terminating in a free end positioned between said upstanding planar element and said deformable hook portion, said clip connector being formed such that the included angle between said upper horizontal planar portion and said flange hook portion is within the range of 15° to 90° before deformation of said flange hook portion and such that the included angle between said deformable flange hook portion and said outermost bend retention hook thereof is within the range of 25° to 90°, a foot formed from the bottom of said planar element and extending therefrom, said foot having an elongated slot formed therein extending horizontally thereof substantially parallel to said body portion, and a washer member overlying said foot, said washer member having an aperture therethrough in alignment with said elongated slot, whereby during thermal movement of said panels, said panels are allowed to move with respect to said supporting members.

2. The clip according to claim 1, wherein said washer member is substantially the same length and width as said foot, whereby when said washer member overlies said foot, the edges thereof coinside with the edges of said foot and said aperture is centered in said slot.

3. The clip connector according to claim 1, wherein said foot comprises a return bent flange, said return bent flange being substantially parallel to said upper portion of said clip connector.

4. A clip connector for anchoring pairs of rigid interlocked metal panels of channel configuration to spaced supporting members comprising a body portion having an upstanding planar element, an upper portion and a deformable flange hook portion extending downwardly from said upper portion, said clip connector being formed such that the included angle between said upper portion and said flange hook portion is within the range of 15° to 90°, a foot formed from the bottom of said planar element and extending therefrom comprising a return bent flange, said return bent flange being substantially parallel to said upper portion of said clip connector, said foot having an elongated slot formed therein extending longitudinally thereof substantially parallel to said body portion, and a washer member overlying said foot, said washer member comprising a U-shaped member which is snugly and slidably received on said return bent flange and having an aperture therethrough in alignment with said elongated slot, said aperture extending through the legs of said U-shaped member in alignment with said elongated slot, whereby during thermal movement of said panels, said panels are allowed to move with respect to said supporting members.

5. The clip connector according to claim 4, wherein an outermost bend retention hook extends from said deformable flange hook portion of said body portion, said clip connector being formed such that the included angle between said deformable flange hook portion and said outermost bend retention hook thereof is within the range of 25° to 90°.

6. A clip connector for anchoring pairs of rigid interlocked metal panels of channel configuration to spaced supporting members comprising a body portion having an upstanding planar element, an upper portion and a deformable flange hook portion extending downwardly from said upper portion, said clip connector being formed such that the included angle between said upper portion and said flange hook portion is within the range of 15° to 90°, a foot formed from the bottom of said planar element and extending therefrom, said foot comprising a pair of U-shaped members extending outwardly from edge portions of the bottom of said planar element and a back clip formed from the remaining intermediate portion of said planar element extending outwardly in the opposite direction from said U-shaped members, said U-shaped members being formed from cuts parallel to the edges of said planar element configured into U-shaped elements with one leg thereof integral with said planar element and the other leg thereof having a free end such that when said clip connector is sandwiched between associated interlocked metal panels, the legs of each said U-shaped member are substantially perpendicular to said planar element and the base of each said U-shaped member is substantially parallel to said planar element, said back clip comprising a first portion co-planar with said planar element, a second portion substantially perpendicular to said first portion and substantially co-planar with those legs of said U-shaped member which have free ends, and a third portion substantially perpendicular to said second portion and substantially parallel to said first portion, said second portion of said foot having an elongated slot formed therein extending longitudinally thereof substantially parallel to said body portion, and a washer member being configured to overlie said second portion of said back-up clip between said first and third portions thereof, whereby during thermal movement of said panels, said panels are allowed to move with respect to said supporting members.

7. The clip connector according to claim 6, wherein an outermost bend retention hook extends from said deformable flange hook portion of said body portion, said clip connector being formed such that the included angle between said deformable flange hook portion and said outermost bend retention hook thereof is within the range of 25° to 90°.

8. The clip connector according to claim 7, wherein said back clip is provided with a fourth portion substantially parallel to said second portion, perpendicular to said third portion and extending from said third portion in a direction opposite to said second portion, said clip connector being configured such that when it is sandwiched between associated interlocked metal panels, said fourth portion is substantially coplanar with the integral legs of said U-shaped members.

9. A clip connector for anchoring pairs of rigid interlocked metal panels of channel configuration to spaced supporting members comprising a body portion having an upstanding planar element, an upper horizontal portion and a deformable flange hook portion extending downwardly from said upper portion, said clip connector being formed such that the included angle between said upper portion and said flange hook portion is within the range of 15° to 90°, a foot formed from the bottom of said planar element and extending therefrom, said foot comprising a pair of first members each having first portions extending outwardly from the edge portions of the bottom of said planar element and a back clip formed from the remaining intermediate portion of said planar element extending outwardly in the opposite direction from said first members, said first members being formed from cuts parallel to the edges of said planar element, the first portions of said first members being substantially normal to said planar element and substantially parallel to said upper portion and to said back clip, said back clip comprising a first portion coplanar with said planar element and a second portion substantially perpendicular to said first portion and said substantially coplanar with said first portions of said first members, said second portion of said foot having an elongated slot formed therein extending longitudinally thereof substantially parallel to said body portion, and a washer member configured to overlie said second portion of said back clip, said washer member having an aperture therethrough in alignment with said elongated slot, whereby during thermal movement of said panels, said panels are allowed to move with respect to said supporting members.

10. The clip connector according to claim 9, wherein an outermost bend retention hook extends from said deformable flange hook portion of said body portion, said clip connector being formed such that the included angle between said deformable flange hook portion and said outermost bend retention hook therefor is within the range of 25° to 90°.

11. The clip connector according to claim 9, wherein said back clip includes a third portion substantially perpendicular to said second portion and substantially parallel to said first portion, and wherein said washer member overlies said second portion of said back clip between said first and third portions thereof.

12. The clip connector according to claim 11, wherein an outermost bend retention hook extends from said deformable flange hook portion of said body portion, said clip connector being formed such that the included angle between said deformable flange hook portion and said outermost bend retention hook therefor is within the range of 25° to 90°.

13. The clip connector according to claim 11, wherein each of said first members includes a second portion substantially perpendicular to said first portion thereof and extending downwardly therefrom in a plane substantially parallel to said planar element, and a third portion substantially parallel to said first portion thereof, perpendicular to said second portion thereof, and extending from said second portion thereof in a direction opposite to said first portion thereof.

14. The clip connector according to claim 13, wherein an outermost bend retention hook extends from said deformable flange hook portion of said body portion, said clip connector being formed such that the included angle between said deformable flange hook portion and said outermost bend retention hook therefor is within the range of 25° to 90°.

15. The clip connector according to claim 13, wherein said back clip is provided with a fourth portion substantially parallel to said second portion thereof, perpendicular to said third portion thereof, and extending from said third portion thereof in a direction opposite to said second portion thereof.

16. The clip connector according to claim 15, wherein an outermost bend retention hook extends from said deformable flange hook portion of said body portion, said clip connector being formed such that the included angle between said deformable flange hook portion and said outermost bend retention hook therefor is within the range of 25° to 90°.

17. The clip connector according to claim 13, wherein said third portion of said back clip has the ends thereof bent at a slight angle toward said first portion thereof to form a first retainer, whereby said washer member is permanently centered with respect to said back clip.

18. The clip connector according to claim 17, wherein said first portion of said back clip is provided with a second retainer extending from the surface thereof over said washer member.

19. The clip connector according to claim 17, wherein said back clip is provided with a fourth portion substantially parallel to said second portion thereof, perpendicular to said third portion thereof and extending from said third portion thereof in a direction opposite to said second portion thereof.

20. The clip connector according to claim 17, wherein an outermost bend retention hook extends from said deformable flange hook portion of said body portion, said clip connector being formed such that the included angle between said deformable flange hook portion and said outermost bend retention hook therefor is within the range of 25° to 90°.

21. The clip connector according to claim 9, wherein the second portion of said back clip comprises a return bent flange.

22. The clip connector according to claim 21, wherein each of said first members include a second portion perpendicular to said first portion thereof and extending downwardly therefrom in a plane substantially parallel to said planar element, and a third portion substantially parallel to said first portion thereof, perpendicular to said second portion thereof, and extending from said second portion thereof in a direction opposite to said first portion thereof.

23. The clip connector according to claim 21, wherein an outermost bend retention hook extends from said deformable flange hook portion of said body portion, said clip connector being formed such that the included angle between said deformable flange hook portion and said outermost bend retention hook thereof is within the range of 25° to 90°.

24. The clip connector according to claim 22, wherein an outermost bend retention hook extends from said deformable flange hook portion of said body portion, said clip connector being formed such that the included angle between said deformable flange hook portion and said outermost bend retention hook therefor is within the range of 25° to 90°.

25. The clip connector according to claim 21, wherein said washer member comprises a U-shaped member which is snugly and slidably received on said return bent flange of said second portion of said back clip, and wherein said aperture extends through the legs of said U-shaped member in alignment with said elongated slot.

26. The clip connector according to claim 25, outermost bend retention hook extends from said deformable flange hook portion of said body portion, said clip connector being formed such that the included angle between said deformable flange hook portion and said outermost bend retention hook therefor is within the range of 25° to 90°.

* * * * *